US005570759A

United States Patent [19]

Zorzi

[11] Patent Number: 5,570,759

[45] Date of Patent: Nov. 5, 1996

[54] BRAKING DEVICE PARTICULARLY FOR SKATES

[75] Inventor: Claudio Zorzi, Paderno di Ponzano Veneto, Italy

[73] Assignee: Nordica S.p.A., Trevignano, Italy

[21] Appl. No.: 439,346

[22] Filed: May 11, 1995

[30] Foreign Application Priority Data

May 23, 1994 [IT] Italy ..... TV94A0056

[51] Int. Cl.[6] ..... A63C 17/14

[52] U.S. Cl. ..... 188/5; 280/11.2

[58] Field of Search ..... 280/11.2, 11.27, 280/11.3; 188/5, 29

[56] References Cited

U.S. PATENT DOCUMENTS 5,308,093 5/1994 Walin ..... 280/11.2

FOREIGN PATENT DOCUMENTS 0567948 11/1993 European Pat. Off. ..... 280/11.2
00585764 3/1994 European Pat. Off. ..... 280/11.2
0608740 8/1994 European Pat. Off. ..... 280/11.2

*Primary Examiner*—Robert J. Oberleitner
*Assistant Examiner*—Chris Schwartz
*Attorney, Agent, or Firm*—Hale and Dorr

[57] ABSTRACT

Braking device, particularly for skates including a shoe associated with a frame having wheels. The device includes a rod member associated with the shoe and with a support for a brake that interacts with the ground. The rod member is hinged to the shoe and to the support through frustum-shaped seats for compensating for the axial offset of the frame with respect to the shoe or the quarter.

12 Claims, 4 Drawing Sheets

118
130
120
115
116
120

111

111
118
120
110
130
120
115
116

113
120
125
115
119
128a
126
110
128b
124
115

112
130
114
126
111
110
109
113
115
116

BRAKING DEVICE PARTICULARLY FOR SKATES

BACKGROUND OF THE INVENTION

The present invention relates to a braking device particularly for skates.

The problem of braking the wheels in order to adjust the speed of the skate is currently felt in conventional roller skates, whether constituted by a shoe associated with a support for two pairs of mutually parallel wheels or constituted by a shoe associated with a supporting frame for a plurality of aligned wheels.

In conventional skates, adapted blocks or pads, usually made of rubber, are placed at the toe or heel regions and when the user tilts the shoe forwards or backwards, the pad interacts with the ground and braking is thus achieved.

The drawback of these conventional brakes is that the user must rotate the whole skate jeopardizing his/her balance.

U.S. Pat. No. 1,402,010 discloses a roller skate having a strap that can be fastened on the user's leg above the malleolar region, a rod being connected thereto.

The rod surrounds the rear of the leg and is curved so as to laterally affect said leg. The rod ends are associated, in the malleolar region, with a lever assembly that is articulated to a structure that protrudes from the wheel supporting frame.

The lever assembly protrudes at the rear of the frame and is connected to a plate shaped approximately complementarily to the curvature of part of an underlying and facing wheel.

This solution has drawbacks: first of all, a relative motion occurs between the strap and the leg throughout sports practice, and this does not make its use comfortable due to the continuous rubbing of the strap on the leg.

Furthermore, the plate is activated every time the user bends his leg backwards beyond a given angle, without true and easy possibility of varying this condition.

Still, since the shape of the leg is different for each user, braking is achieved for different rotation angles for an equal rod length.

The rod also acts and presses in the malleolar region, and this can cause discomfort or produce accidental impacts during sports practice.

Finally, considerable wheel wear is observed, forcing continuous replacement of said wheels and accordingly increasing costs.

U.S. Pat. No. 4,275,895 discloses a brake acting on the rear wheels of a skate with mutually parallel pairs of wheels.

Said brake is constituted by a flap associated with the shoe in a rearward position; a blade is associated in a rearward position with said flap and is pivoted at the supporting frame of the shoe.

Said blade has, at its free end, a transverse element, two C-shaped elements being formed at the lateral ends thereon; said elements interact, following a backward rotation applied to the flap, with the rear wheels facing them, so as to interact with the rolling surface of said wheels.

However, even this solution has drawbacks: it is in fact structurally complicated and therefore difficult to industrialize; it also has adapted springs for repositioning the flap in the condition in which the two C-shaped elements do not interact with the wheels, and this further increases structural complexity.

Furthermore, the structural configuration of the brake causes the two C-shaped elements to interact with the wheel even upon a minimal backward rotation applied to the flap and therefore even for involuntary movements, thus producing unwanted braking actions and, accordingly, possible loss of balance or coordination.

Finally, the interaction of the C-shaped element at the rolling surface of the wheels leads to their rapid wear and therefore to non-optimum rolling, which necessarily leads to continuous replacement of said wheels.

U.S. Pat. No. 4,300,781 discloses a brake for skates having pairs of mutually parallel wheels.

The brake is constituted by a blade pivoted transversely at the rear end of the supporting frame for a shoe; pads are associated with the ends of said blade and face the rolling surface of the pair of rear wheels.

The brake is operated by using a cable adapted to rotate the blade in contrast with a spring that is associated with the support for the pair of front wheels, so as to move the pads into contact with the rolling surface of the pair of rear wheels.

Said cable is activated by means of rings or handles associated with a strap that can be placed on the user's legs by means of temporary connection means.

However, this solution has considerable drawbacks; first of all, brake activation can lead to possible loss of balance during sports practice, because the user's body does not assume a position that can control the sudden speed reduction; only the skater's hand is in fact involved in the activation of the brake.

Furthermore, as sports practice can occur while wearing trousers, when traction is applied to the rings the strap may slip along the trousers or drag them so that they slide along the leg, thus hindering the braking action.

Furthermore, there is a loose cable that, in addition to being a hindrance to the skater, can accidentally catch during racing, especially because coordination of the armleg movement causes the legs to move rhythmically laterally outwards.

U.S. Pat. No. 4,033,596 discloses a roller-ski that has, in addition to engagement means for the tip of a shoe, braking means substantially constituted by a bar that protrudes above a supporting frame for the shoe in the rear region thereof; said bar is pivoted transversely to said frame at one end and has, at the other end, a curved plate for supporting the user's calf.

A frame is associated transversely and to the rear of the bar; once the bar has been rotated backwards, said frame interacts with the rolling surfaces of two wheels that are in turn freely pivoted to the supporting frame for the shoe.

This brake cannot be efficiently used for roller skates, because skating entails continuous oscillations of the leg that can lead to unwanted activations of the braking action.

Moreover, the presence of the bar would be dangerous for the user, constituting a blunt body that is completely independent of the leg and might therefore be dangerous in case of a fall.

Furthermore, the described solution does not allow to achieve a gradual braking action.

U.S. Pat. No. 5,388,844 granted on Feb. 14, 1995 discloses a braking device comprising a rod member connected to the shoe quarter and sliding with respect to the shell. The rod member has a fork-like end that interacts with one or more of the wheels beyond a preset backward rotation angle of the quarter.

Although this solution is undoubtedly an improvement and is valid, it has some small drawbacks related to the fact that it is not possible to easily achieve good graduality in the braking action, as this is mainly entrusted to the skill and sensitivity of the user.

U.S. patent application Ser. No. 08/115.416 filed Sep. 1, 1993 discloses a braking device comprising a rod member that can slide with respect to the shell, is pivoted transversely to the shoe quarter at one end, and lies above, or is associated with, a braking element at the other end; said braking element is oscillatably articulated to said frame and selectively interacts with the ground.

Although this solution is undoubtedly valid, it has the drawback that it does not allow optimum alignment of the brake with the ground when the shell is shifted laterally with respect to the frame; this condition is provided by the user, both for roller skates and for ice skates, if he wishes to customize the configuration of the skate, for example to improve lateral thrusting, according to the sport practiced and to the shape of his foot.

SUMMARY OF THE INVENTION

The aim of the present invention is therefore to solve the described technical problems, eliminating the drawbacks described above in conventional skates by providing a braking device for skates that allows to achieve good graduality in the braking action even when the shell is shifted laterally with respect to the wheel supporting frame.

Within the scope of this aim, an important object is to provide a braking device the optimum activation whereof, in the possible configurations of the shell with respect to the frame, occurs automatically and therefore without forcing the user to perform any adjustment of said braking device.

Another object is to provide a braking device that is structurally simple, easy to industrialize, reliable and safe in use and has low manufacturing costs.

This aim, these objects, and others which will become apparent hereinafter are achieved by a braking device, particularly for skates comprising a shoe portion, a frame having a plurality of wheels, a brake member, a rod member kinematically connecting said shoe portion, said frame and said brake member, characterized in that it comprises compensating means for compensating any axial offset of said frame with respect to said shoe portion.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein:

FIG. 11*a* is an enlarged view of a portion of FIG. 11;

FIG. 12*a* is an enlarged view of a portion of FIG. 12.

DESCRIPTION OF THE PREFERRED EMBODIMENTS

Figure 1:
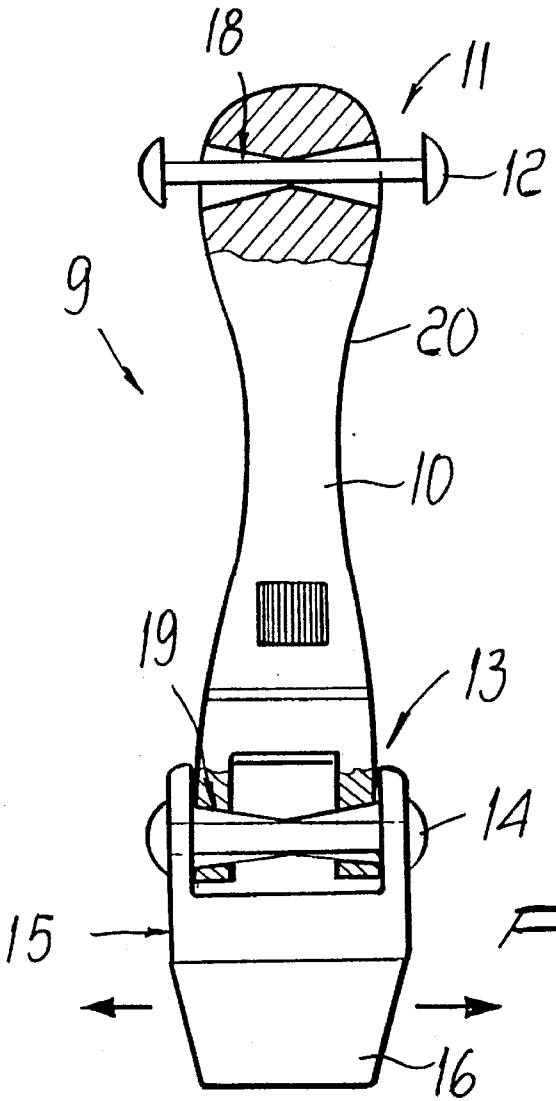
FIG. 1 is a simplified partially sectional rear view of the braking device according to the invention.
Figure 5:
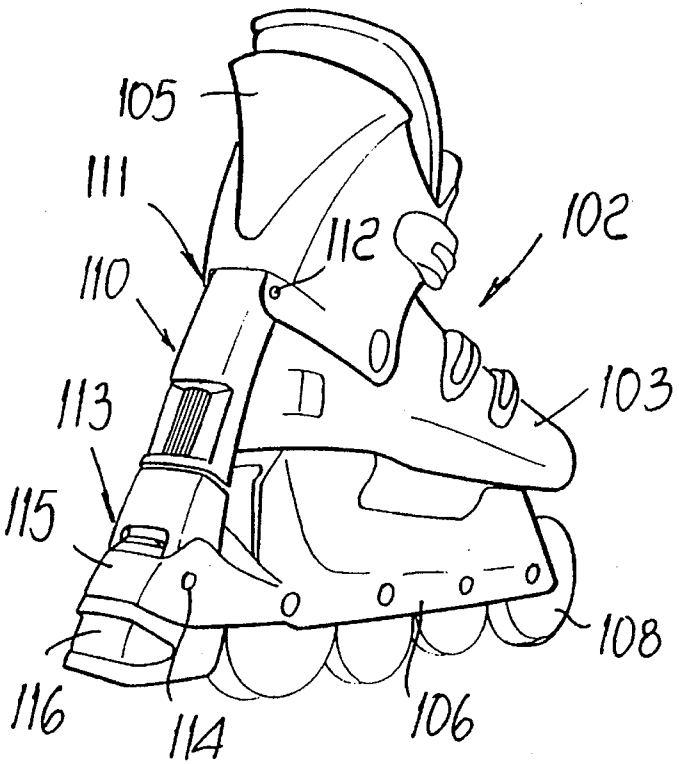
FIG. 5 is a rear perspective view of a skate provided with the braking device, according to a second aspect of the invention.
Figure 4:
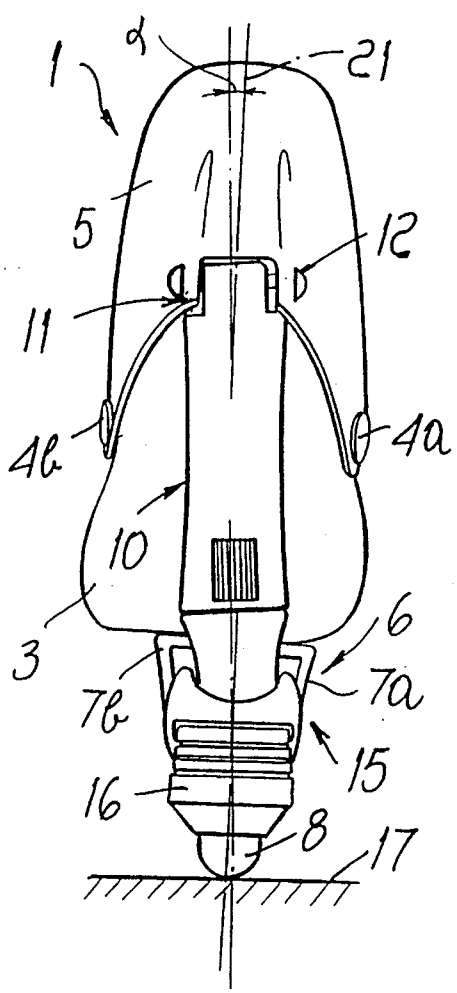
FIG. 4 is a view, similar to FIG. 3, of the skate in a third condition in which the frame and the shoe are mutually axially offset to the left.
Figure 3:
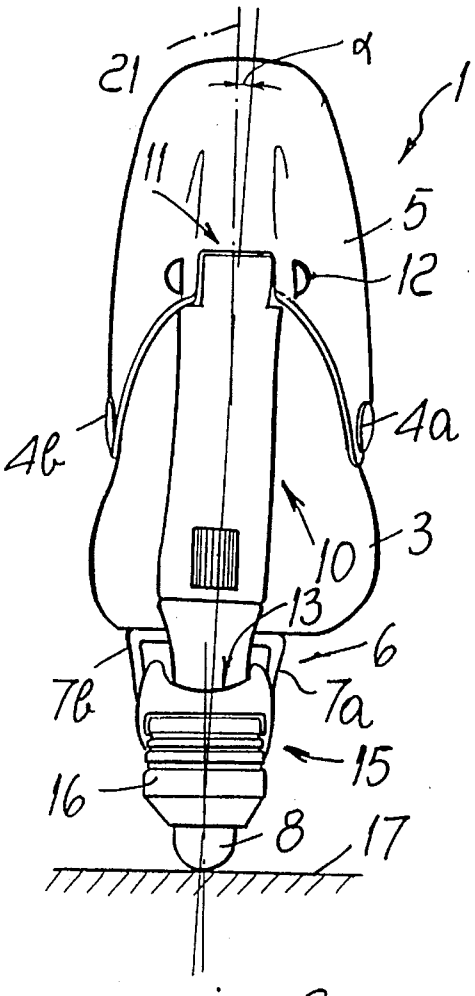
FIG. 3 is a view, similar to FIG. 2, of the skate in the condition in which the frame and the shoe are mutually axially offset to the right.
Figure 2:
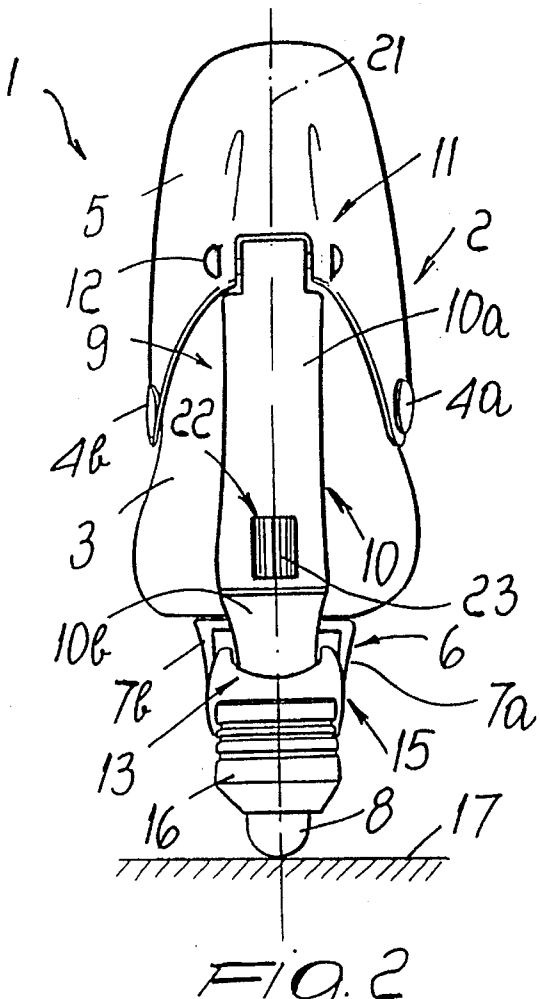
FIG. 2 is a rear view of the skate in the condition in which the frame, the support, and the quarter are aligned.
Figures 6, 7, 8, 9, 10:
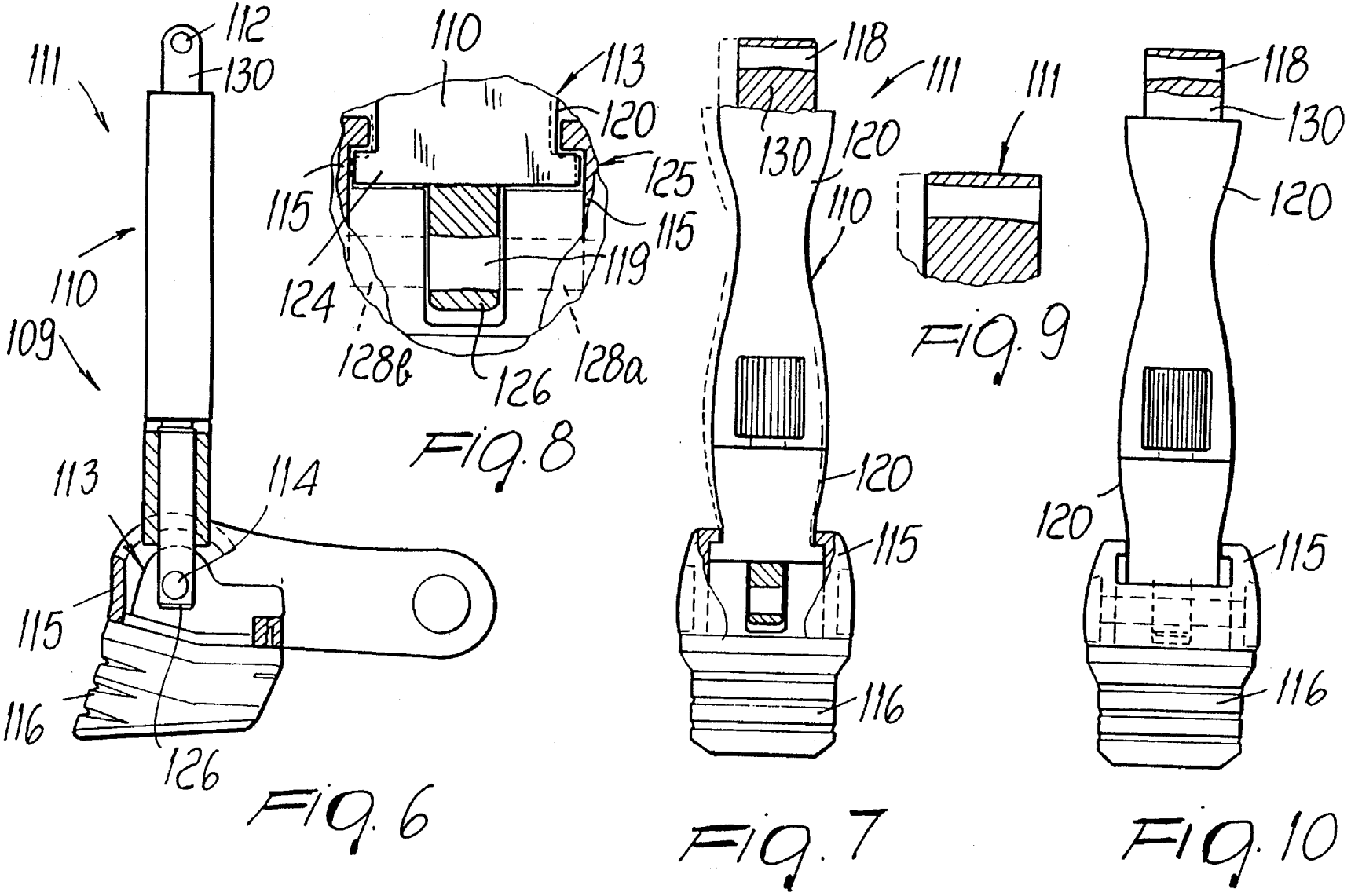
FIG. 6 is a partially sectional side view of a second embodiment of the braking device.
FIG. 7 is a partially sectional rear view of the support of FIG. 6.
FIG. 8 is an enlarged first detail view of an upper portion of the support of FIG. 7.
FIG. 9 is an enlarged, second detailed view of a lower portion of the support of FIG. 8.
FIG. 10 is a rear view, similar to FIG. 7, of the support of FIG. 6.

With reference to the figures, the reference numeral 1 designates a skate comprising a shoe 2 which is composed of a shell 3 to which at least one quarter 5 is articulated at first studs 4*a* and 4*b*.

The shoe 2 is associated with a U-shaped frame 6, between the shoulders 7*a* and 7*b* whereof a plurality of aligned wheels 8 are pivoted.

The braking device, generally designated by the reference numeral 9, comprises a rod member 10 that is transversely associated, at a first end 11, with said quarter 5 by means of a first pivot 12 and is transversely associated, at a second end 13, by means of a second pivot 14, with a support 15 for a brake 16 that interacts with the ground 17.

Advantageously, means 22 are associated with the rod member 10 and adjust its longitudinal extension; said means is for example constituted by a knob 23 rotatably associated with a first body 10*a* that is pivoted to the quarter and has a threaded stem that interacts with a second body 10*b* that is pivoted to the support 15.

The braking device furthermore comprises means for compensating for the axial offset of said frame 6 with respect to said shoe 2 or quarter 5. Said means is formed at said rod member 10 and particularly at the first and second ends.

Said means is constituted by the first seat 18 for the first pivot 12 and by the second seat 19 for the second pivot 14. Said first and second seats are frustum-shaped and mirror-symmetrical with respect to the longitudinal central axis of the support and their larger end is directed towards the edge 20 of said rod member 10.

The rod member 10 can therefore perform a relative movement with respect to the brake 16 and to the corresponding support 15 thereof; accordingly, the rod member can follow the lateral shift of the quarter 5, which moves rigidly with the shell 3, tilting at an angle $\alpha$ with respect to an axis 21 that is vertical with respect to the ground 17, whereas the support 15 remains invariably in its position.

This relative motion, which is substantially an oscillation about the first and second pivots for the pivoting of the rod member 10 to the quarter 5 and to the support 15, allows the brake 16 to operate always at right angles to the ground 17 and therefore to wear uniformly on its contact surface, furthermore providing maximum effectiveness in its braking action.

It is thus evident that the invention has achieved the intended aim and objects, a braking device having been provided that allows the user to achieve optimum graduality in braking even when the shell is shifted laterally with respect to the wheel supporting frame.

The brake furthermore optimally interacts with the ground regardless of the relative arrangement of the shoe and of the frame with respect to the brake, as the rod member 10 adapts to the various conditions automatically and therefore without requiring the user to perform any adjustment on said braking device.

Furthermore, the support 15 is not subjected to tension loads when the shoe and the quarter are axially offset with respect to the frame; said loads, which are discharged onto the pivot connecting the support to the frame, can rapidly lead to the breakage of said support or of said pivot, also causing deterioration of the region of the frame whereat the connection is provided.

The device according to the invention is of course susceptible of numerous modifications and variations, all of which are within the scope of the same inventive concept.

Thus, for example, FIGS. 5 to 9 illustrate another embodiment, wherein the braking device 109 comprises a rod member 110 having a first end 111 wherefrom a tab 130 protrudes axially, a first frustum-shaped, mirror symmetrical seat 118 for a first pivot 112 for pivoting to the quarter 105 being formed transversely on said tab.

The rod member 110 has a second substantially T-shaped end 112, the head 124 whereof is accommodated, with a clearance that allows rotation or oscillation, in a third seat 125 formed above said support 115 for the brake 116.

A stem 126 protrudes from the head 124 axially with respect to the rod member 110 and towards the support 115; said stem 126 is accommodatable within a complementarily shaped fourth seat 127 formed on the support 115 and has a second transverse, frustum-shaped, mirror-symmetrical seat 119 for accommodating a second pivot 114 that fits, at its ends, in adapted holes 128*a* and 128*b* having the same axis and formed on said support to allow pivoting thereto.

The braking device comprises means for compensating for the axial offset of the frame 106 with respect to said shoe 102 or quarter 105, said means being formed at said rod member 110, and particularly at the tab 130 and at the stem 126 that protrude from said first and second ends.

Said means are constituted by the first seat 118 for the first pivot 112 and by the second seat 119 for the second pivot 114; said first and second seats are frustum-shaped and mirror-symmetrical with respect to the longitudinal central axis of the support, and their larger end is directed towards the perimetric edge 120 of said rod member 110.

In this case, too, as in the previous embodiment, the shape of the first and second seats and the clearance allowed to the head 124 of the rod member allow, by virtue of the pivoting provided by means of the first and second pivots, said rod member to perform a first movement along a vertical plane that lies substantially longitudinally to said shoe and a second movement, on a vertical plane that lies approximately at right angles to the preceding one; it is thus possible to have a braking device with two degrees of freedom that allows to compensate for the lateral shift of the quarter and of the shell with respect to the frame and for any rotation of the quarter with respect to the shell.

Figure 12:
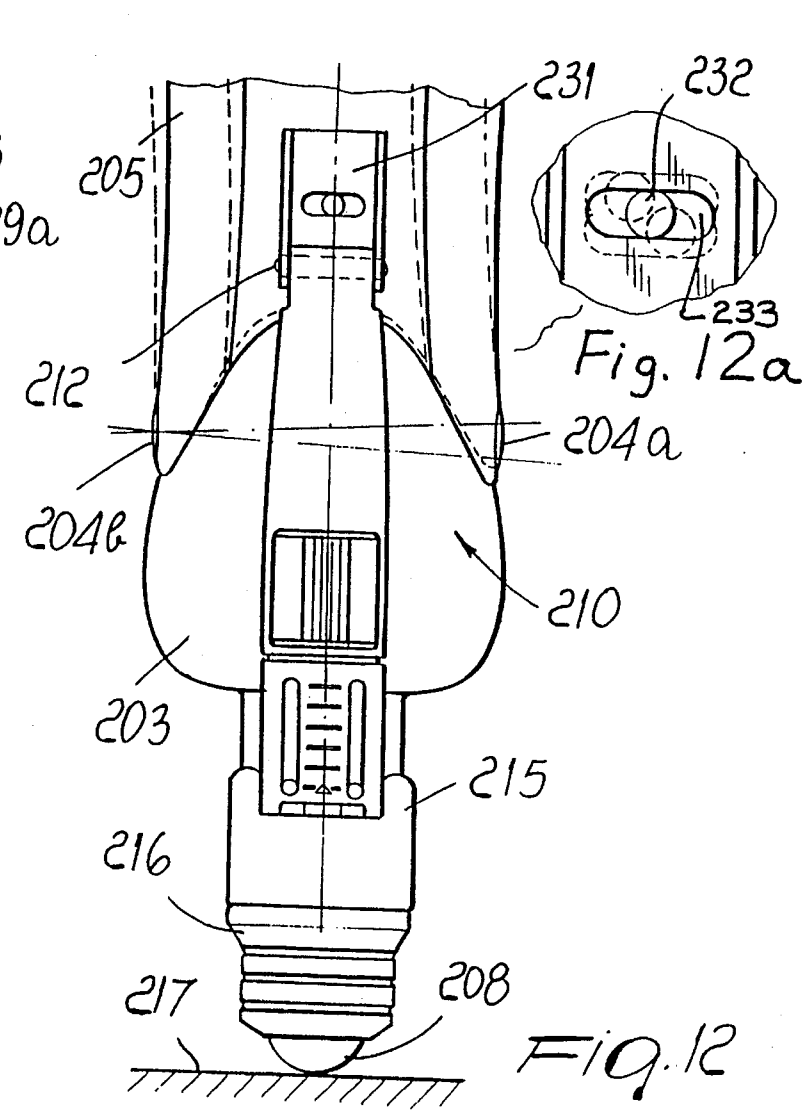
FIG. 12 is a view, similar to FIG. 11, of the skate in the condition in which the quarter is rotated with respect to the shell.
Figure 11:
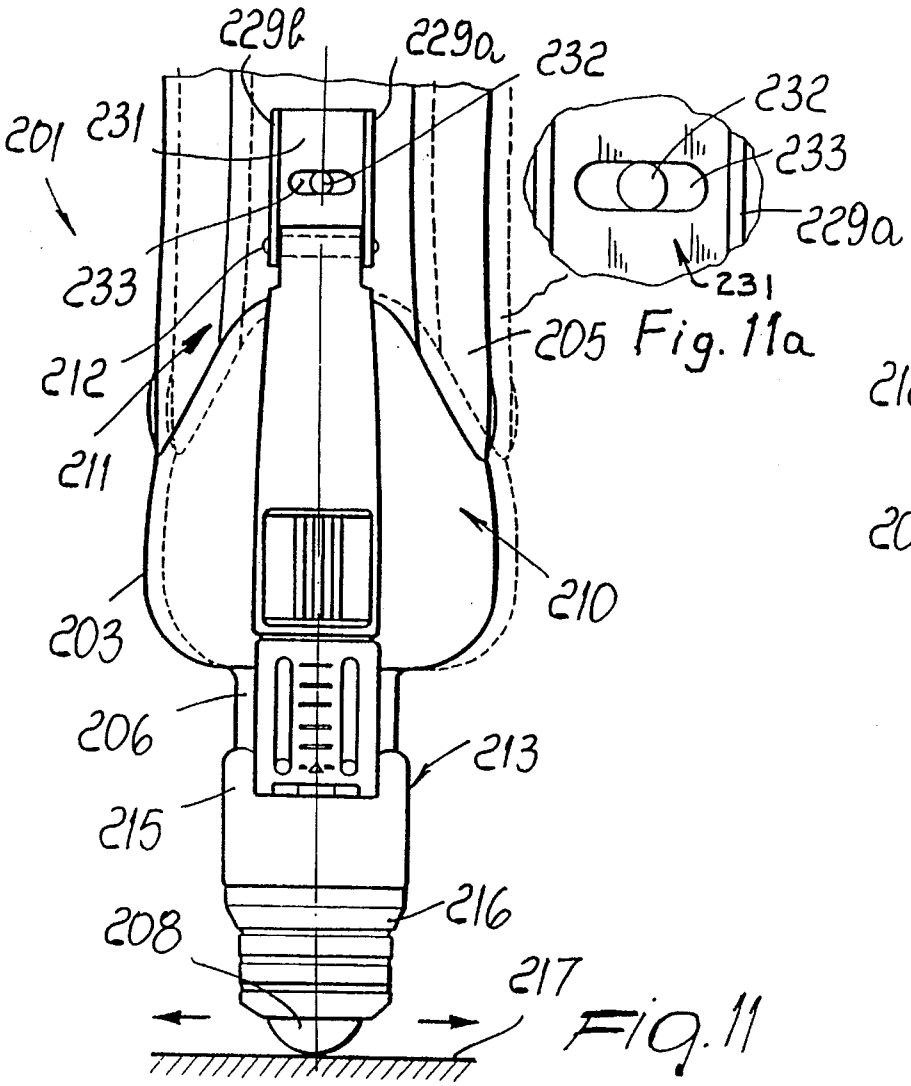
FIG. 11 is a side view of a third embodiment in the condition for compensating the lateral shift of the quarter and of the shell with respect to the frame.

A third embodiment for a skate 201 is shown in FIGS. 11 and 12, wherein the rod member 210 has a first end 211 that is transversely associated, by means of a first pivot 212, with the wings 229*a* and 229*b* of a plate 231 that is in turn slidingly connected to the quarter 205 by means of a third pivot 232 located at an adapted slot 233 formed on the base of the plate 231 connecting the wings 229*a* and 229*b*.

The slot 233 is formed at an axis that is approximately parallel to the axis of the first pivot 212.

The rod member 210 is transversely associated, at its second end 213, with the support 215 for the brake 216.

This embodiment again allows, as shown in FIG. 11, a lateral movement of the shell 203 and of the quarter 205 with respect to the frame 206, with which the wheels 208 are rotatably associated; in this embodiment, the position of the rod member 210 is always vertical with respect to the ground 217, and the quarter 205 of the shoe can shift along the slot 233.

Likewise, FIG. 12 illustrates a condition wherein adapted conventional means for varying the angular position of the quarter with respect to the shell (canting) are associated at the studs 204*a* and 204*b* for the pivoting of the quarter 205 to the shell 203.

Differently from the preceding embodiments, this last one has the additional advantage that the rod member 210 operates at right angles to the ground regardless of the position of the quarter or of the shoe with respect to the frame. The load applied during the braking action is accordingly exclusively vertical (load applied axially at the tip), without horizontal components that would subject said rod member to flexural stress and might cause, in the long term, a certain wear thereof.

The materials employed, as well as the dimensions of the individual components of the braking device, may of course be the most pertinent according to the specific requirements.

What is claimed is:

1. In a skate comprising a shoe, a frame having a plurality of wheels, a brake positioned rearwardly with respect to said frame and arranged for movement generally upwardly and downwardly relative to said frame between a first position in which said brake provides a braking action and a second position spaced generally above said first position in which said brake is disengaged from said braking action, and an actuator having a longitudinally-extending axis, disposed rearwardly of said shoe, and having an upper portion thereof connected to said shoe by a first connector and a lower portion thereof connected to said brake by a second connector, the improvement wherein:

at least one of said connectors permits said actuator to move relative to the one of said shoe and said brake associated with said at least one connector in a first plane that is generally vertical and transverse to said shoe and said frame, in response to lateral shifting of said shoe relative to said frame.

2. The skate of claim 1 wherein said connectors are constructed such that said actuator is pivotally movable in said first plane relative to both said shoe and said brake element in response to said lateral shifting.

3. The skate of claim 2 wherein said brake includes a brake support for a brake member that interacts with the ground, said first connector includes a first end of said actuator transversely associated with said shoe by means of a first pivot, and said second connector includes a second end of said actuator transversely associated with said brake support by means of a second pivot.

4. The skate of claim 3 wherein each of said first and second pivots includes a pair of frustum-shaped, mirror-symmetrical seats, the larger end of each of said seats being directed laterally outwardly towards a respective side of said actuator.

5. The skate of claim 4 wherein said first connector includes a tab protruding from said first end of said actuator and having a first seat for said first pivot, said second end is substantially T-shaped, said second connector includes a third seat formed above said support for said brake, and the head of said T-shaped end is accommodated in said third seat with a clearance that allows oscillation of said activator relative to said support.

6. The brake of claim 5 wherein a stem protrudes from said head of said T-shaped end axially with respect to said actuator and towards said support, said stem being arranged within a complementarily shaped seat formed on said support and having a transverse seat for accommodating said first pivot, said first pivot fitting at its ends in adapted holes coaxial therewith and formed on said support for pivoting thereto.

7. The skate of claim 2 wherein each of said connectors is constructed so that said rod member is pivotally movable in said first plane and also in a second generally vertical plane that lies substantially longitudinally with respect to said shoe and at approximately a right angle to said first plane.

8. The brake of claim 1, wherein said first connector provides for transverse slidable movement of said upper end of said actuator relative to said shoe.

9. The brake of claim 8 wherein said first connector includes a plate that is connected to said shoe and is slidingly movable relative to said shoe.

10. The brake of claim 9 wherein said upper portion of said actuator has an end transversely associated by a pivot with wings of said plate, and said plate is connected to said shoe by a slot formed in said plate.

11. The brake of claim 10 wherein said slot has a longitudinal axis that is approximately parallel to the axis of said pivot.

12. The brake of claim 11 wherein connector maintains the alignment of said actuator relative to said brake when said shoe shifts laterally to said frame, said slot permitting said shoe to shift relative to said actuator.

* * * * *